US006603373B2

(12) United States Patent
Tsujiguchi

(10) Patent No.: US 6,603,373 B2
(45) Date of Patent: Aug. 5, 2003

(54) ADJUSTING METHOD FOR ELECTRICAL CHARACTERISTICS OF MICROSTRIP LINE FILTER, DUPLEXER, COMMUNICATION DEVICE, AND MICROSTRIP LINE TYPE RESONATOR

(75) Inventor: Tatsuya Tsujiguchi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/854,263

(22) Filed: May 11, 2001

(65) Prior Publication Data

US 2002/0003460 A1 Jan. 10, 2002

(30) Foreign Application Priority Data

May 11, 2000 (JP) ..... 2000-138253

(51) Int. Cl.[7] ..... H01P 1/203

(52) U.S. Cl. ..... 333/204; 333/205; 333/134

(58) Field of Search ..... 333/204, 205, 333/235, 134

(56) References Cited

U.S. PATENT DOCUMENTS

| | | | | |
|---|---|---|---|---|
| 4,168,479 A | | 9/1979 | Rubin | |
| 4,551,696 A | * | 11/1985 | Moutrie et al. | 333/204 |
| 5,172,084 A | * | 12/1992 | Fiedziuszko et al. | 333/204 |
| 5,703,544 A | * | 12/1997 | Hays, III | 333/204 |
| 5,986,521 A | * | 11/1999 | Tada et al. | 333/134 |
| 6,181,225 B1 | * | 1/2001 | Bettner | 333/204 |
| 6,184,760 B1 | * | 2/2001 | Wada et al. | 333/204 |
| 6,225,878 B1 | * | 5/2001 | Takahashi et al. | 333/204 |
| 6,313,719 B1 | * | 11/2001 | Barnett et al. | 333/202 |
| 6,450,034 B1 | * | 9/2002 | Suzuki et al. | 333/205 |

FOREIGN PATENT DOCUMENTS

| | | |
|---|---|---|
| EP | 2000-68701 | 3/2000 |
| JP | 02141675 | 5/1990 |
| JP | 2668423 | 7/1997 |

OTHER PUBLICATIONS

Flechet et al., "In Situ Microwave Characterization of Insulator Thin Films for Interconnects of Advanced Circuits", Microwave Symposium Digest, New York, NY, pp. 961–964, vol. 2 (1998).

Robertson et al., "Micromachined Self–Packaged W–Band Bandpass Filters", Microwave Symposium Digest, pp. 1543–1546 (1995).

Dawe et al., "Characterization of Active and Passive Millimeter–Wave Monolithic Elements by On–Wafer Probing", MTT–S International Microwave Symposium Digest, pp. 413–415 (1989).

Abstract of Japanese Publication No. 10294604.

Abstract of Japanese Publication No. 58073203.

Copy of European Search Report dated Mar. 21, 2003.

* cited by examiner

*Primary Examiner*—Seungsook Ham

(74) *Attorney, Agent, or Firm*—Dickstein, Shapiro, Morin & Oshinsky, LLP.

(57) ABSTRACT

A method is disclosed which allows the electrical characteristics of a microstrip line filter or the like to be reliably measured using a two-dimensional measuring jig, even if components thereof to be measured are small in size and are not discrete components. A first ground electrode is formed substantially over the entire bottom surface of a dielectric substrate, and resonator electrodes are disposed on the top surface of the dielectric substrate. Input/output electrodes are each connected to a first-stage resonator electrode and a last-stage resonator electrode. Second ground electrodes conductively connected to the first ground electrode are disposed beside each of the input/output electrodes. By this structure, each of the input/output portions is provided with a grounded coplanar guide configuration.

13 Claims, 5 Drawing Sheets

ADJUSTING METHOD FOR ELECTRICAL CHARACTERISTICS OF MICROSTRIP LINE FILTER, DUPLEXER, COMMUNICATION DEVICE, AND MICROSTRIP LINE TYPE RESONATOR

BACKGROUND OF THE INVENTION

1. Field of the Invention

The present invention relates to a method for adjusting electrical characteristics of a filter and a duplexer constructed by forming a microstrip line on a dielectric substrate, and to a method for adjusting the electrical characteristics of a communication device and a microstrip line type resonator including such a filter or duplexer.

2. Description of the Related Art

FIG. 9 shows a constructional example of a conventional microstrip line filter. In this filter, resonator electrodes 11, 12, and 13, and input/output electrodes 21 and 23 led out from the respective resonator electrodes 11 and 13 are formed on the top surface of a dielectric substrate 1. A first ground electrode is formed substantially over the entire bottom surface of the dielectric substrate 1. By this construction, each of the resonator electrodes 11, 12, and 13 functions as a microstrip line resonator which generates a half-wavelength resonance in the operational frequency band thereof, each of the input/output electrodes 21 and 23 functions as an electrode (terminal) for external lead-out, and the overall microstrip line filter functions as a filter having band-pass characteristics provided by the three resonator stages.

A device for measuring the characteristics of high-frequency circuits for use in a microwave band and the like is disclosed in Japanese Patent No. 2668423. In order to measure the characteristics of a microstrip line filter as shown in FIG. 9, it is necessary to connect the ground electrode of a measuring jig to the ground electrode (bottom surface of the dielectric substrate) of the filter, and to connect a respective signal electrode of the measuring jig to each of the input/output electrodes 21 and 23. As a result, the measuring jig must be made to contact the top surface and the bottom surface of the dielectric substrate. This raises the problem that the structure of the measuring jig becomes complicated, resulting in an increased production cost. Furthermore, when measuring the characteristics of a small filter, for example, of about 5 mm square or below, the fixing of the filter and the connection of the electrodes to the filter becomes difficult since the measuring jig has a three-dimensional configuration.

Typically, the microstrip line filters are set one-by-one on a measuring jig and the characteristics thereof are measured, and adjusted, for example, by trimming off electrode portions. However, this method for measuring and adjusting the characteristics of the filters creates the problems that a very large number of man-hours is needed, and that the dielectric substrates are easily subject to cracking and chipping during the handling of the filters.

In the high-frequency circuit measuring instrument disclosed in the above-mentioned patent, the measurement of characteristics is performed by connecting together a measuring substrate having a grounded-coplanar structure and a component constituting a high-frequency circuit to be measured. It is, therefore, necessary to mount a high-frequency circuit to be measured, such as the microstrip line filter, onto the measuring instrument. Hence, such a high-frequency circuit measuring instrument is difficult to apply to the measurement and adjustment of the characteristics of the products of microstrip line filters at the point in time when they are produced. Also, in the high-frequency circuit measuring instrument disclosed in the above-mentioned patent, since the measurement of characteristics must be performed for each individual component, the problem of requiring a large number of man-hours, and that of being prone to cause cracking and chipping still remain unsolved.

SUMMARY OF THE INVENTION

The present invention solves the above-described problems by providing a method for adjusting electrical characteristics of a microstrip line filter and a microstrip line duplexer which allows the electrical characteristics, such as resonance frequency, to be measured using a two-dimensional measuring jig, and which allows the electrical characteristics to be measured on an aggregate substrate basis rather than on discrete component basis. The invention further provides a method for adjusting electrical characteristics of a communication device and/or a microstrip line type resonator included in such a microstrip line filter or microstrip line duplexer.

In accordance with a first aspect, the present invention provides a microstrip line filter which comprises (i) a dielectric having a top surface and a bottom surface, (ii) a plurality of resonator electrodes provided on the top surface of the dielectric substrate, including at least a first-stage resonator electrode and a last-stage resonator electrode, (iii) an input/output electrode which is connected to at least one of the first-stage and last-stage resonator electrodes, and which is provided on the top surface of the dielectric substrate, (iv) a first ground electrode which is provided on the bottom surface of the dielectric substrate, and which is disposed so as to be opposed to the resonator electrodes with the dielectric substrate therebetween, and (v) at least one second ground electrode which is provided on the top surface of the dielectric substrate, and which is conductively connected to the first ground electrode.

In this way, the microstrip line filter in accordance with the first aspect has a so-called grounded coplanar structure wherein the at least one second ground electrode conductively connected to the first ground electrode is flush with the surface on which the resonator electrodes are disposed. Further, the electrodes necessary to measure the electrical characteristics of this filter are formed on the top surface of the dielectric substrate. Therefore, the electrical characteristics of the filter can be easily measured, and the adjustment of the electrical characteristics thereof can be executed with reliability.

In this aspect, preferably, at least one second ground electrode is provided adjacent to the input/output electrode, and further, preferably, two second ground electrodes are provided on respective sides of the input/output electrode.

The first ground electrode and the second ground electrode may be connected via a through hole provided in the dielectric substrate, or the first ground electrode and the second ground electrode may be connected via a side electrode provided on the side surface of the dielectric substrate.

In this aspect, it is preferable that the plurality of resonator electrodes be arranged in line from one end of the dielectric substrate to the opposite end thereof. Preferably the input/output electrode connected to the first-stage resonator electrode is provided at one end of the dielectric substrate, while the input/output electrode connected to the last-stage resonator electrode is provided at the other end of the dielectric substrate.

In accordance with a second aspect, the present invention provides a duplexer which comprises a transmitting-circuit side terminal, a receiving-circuit side terminal, and an antenna terminal, and which has a microstrip line filter in accordance with the first aspect of the invention connected between the transmitting-circuit side terminal and the antenna terminal, and/or between the receiving-circuit side terminal and the antenna terminal.

As in the case of the above-described microstrip line filter, since the duplexer has also a so-called grounded coplanar structure wherein the second ground electrode conductively connected to the first ground electrode is provided flush with the surface on which the resonator electrodes are disposed, and wherein electrodes necessary to measure the electrical characteristics of this duplexer are formed on the top surface of the dielectric substrate, the electrical characteristics of the duplexer can be easily measured, and the adjustment of the electrical characteristics thereof can be executed with reliability.

In this duplexer, it is desirable that the second ground electrodes be formed adjacent to both ends of each of the transmitting-circuit side terminal, the receiving-circuit side terminal, and the antenna terminal.

In accordance with a third aspect, the present invention provides a communication device which comprises a microstrip line filter in accordance with the first aspect, or a duplexer in accordance with the second aspect, the microstrip line filter or the duplexer being provided in, for example, a high-frequency circuit which handles communication signals.

In accordance with a fourth aspect, the present invention provides a method for adjusting the electrical characteristics of a microstrip line type resonator. This method comprises the steps of: (a) providing an aggregate substrate which includes a plurality of microstrip line type resonators, each of the microstrip line type resonators comprising (i) a dielectric having a top surface and a bottom surface, (ii) a plurality of resonator electrodes which are provided on the top surface of the dielectric substrate, and which include at least a first-stage resonator electrode and a last-stage resonator electrode, (iii) an input/output electrode which is connected to at least one of the first-stage and last-stage resonator electrodes, and which is provided on the top surface of the dielectric substrate, (iv) a first ground electrode which is provided on the bottom surface of the dielectric substrate and which is disposed so as to be opposed to the resonator electrodes with the dielectric substrate therebetween, and (v) at least one second ground electrode which is provided on the top surface of the dielectric substrate, and which is conductively connected to the first ground electrode; (b) placing the probe of a measuring instrument for measuring the electrical characteristics of the microstrip line type resonators in contact with the input/output electrodes and the second ground electrodes, on the aggregate substrate; and (c) adjusting the electric characteristics of the microstrip line type resonators while measuring the electrical characteristics of the discrete microstrip line type resonators.

In accordance with the method for adjusting the electrical characteristics of a microstrip line type resonator, it is possible to adjust the electrical characteristics, such as resonance frequency, of a microstrip line type resonator in a microstrip line filter and a microstrip line duplexer, for example, in the form of an aggregate substrate, and to thereby simplify the adjustment of the electrical characteristics.

Other features and advantages of the present invention will become apparent from the following description of embodiments of the invention which refers to the accompanying drawings, in which like references denote like elements and parts.

BRIEF DESCRIPTION OF THE DRAWINGS

FIGS. 3A and 3B are views illustrating how the characteristics of the filter shown in FIG. 1 are measured, wherein FIG. 3A is a top view and FIG. 3B is a side view;

DETAILED DESCRIPTION OF EMBODIMENTS OF THE INVENTION

The configuration of a microstrip line filter in accordance with a first embodiment of the present invention, and an adjusting method for this microstrip line filter will be described with reference to FIGS. 1 through 4.

Figure 1:
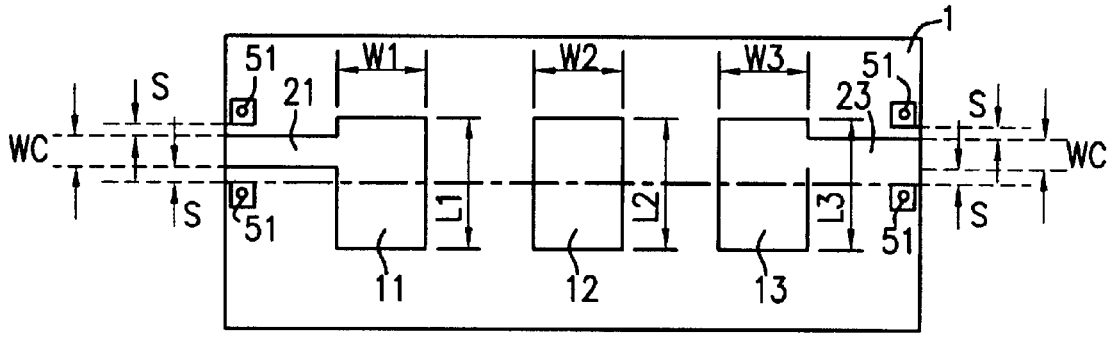
FIG. 1 is a plan view showing the main section of a filter in accordance with a first embodiment of the present invention.

FIG. 1 is a plan view showing this filter. On the top surface of the dielectric substrate 1, three resonator electrodes 11, 12, and 13, and input/output electrodes 21 and 23 are formed. The resonator electrodes 11, 12, and 13 have electrode lengths L1, L2, and L3, and electrode widths W1, W2, and W3, respectively. Each of the resonator electrodes 11, 12, and 13 functions as a microstrip line resonator which generates a half wavelength resonance at the operating frequency thereof. These resonators electrodes 11, 12, and 13 are arranged so that the longitudinal directions of the electrodes become parallel with one other, and so that the centers of the electrode lengths of the resonator electrodes are aligned substantially linearly from one end to the other end of the dielectric substrate, as shown by the chain line (center line) in the figure.

Input/output electrodes 21 and 23 having width WC extend along the longitudinal direction of the filter. They are spaced apart from second ground electrodes 51 by a spacing S. The input/output electrodes 21 and 23 are connected to a first-stage resonator electrode 11 and a last-stage resonator electrode 13, respectively.

The input/output electrodes 21 and 23 are connected to the first-stage resonator electrode 11 and the last-stage resonator electrode 13, respectively, at positions such that they are spaced apart from the longitudinal centers of the resonator electrodes along the longitudinal direction thereof by the spacing S. That is, the input/output electrodes 21 and 23 are formed as electrode patterns which extend from the predetermined positions of the resonance electrodes 11 and 13 to one end and the other end, respectively. A first ground electrode, which is opposed to the resonator electrodes 11 through 13 with the dielectric substrate therebetween, is formed substantially over the entire bottom surface of the dielectric substrate.

The second ground electrodes 51, which are conductively connected to the first ground electrode on the bottom surface via through holes, are formed on both sides of each of the input/output electrodes 21 and 23, on the top surface of the dielectric substrate 1. Each of the input/output portions is thereby provided with a coplanar structure.

The above-described resonator electrodes 11, 12, and 13, input/output electrodes 21 and 23, second ground electrodes 51, and first ground electrode on the bottom surface are formed by the thick-film printing method with respect to the surface of the dielectric substrate 1, or by the patterning of thin conductive strips. The through hole portions may be formed using a method similar to the conventional method wherein, after holes have been formed in the dielectric substrate 1, an electrode film is formed on the inner surface of each of the holes.

In a conventional microstrip line filter, since the impedance of each of the input/output portions of the filter is set to 50 Ω, the line width of the input/output electrode is determined by the thickness and the permittivity of the dielectric substrate, and hardly any versatility in design is available. In contrast, in a grounded coplanar structure as shown in FIG. 1, since the line impedance can be changed by changing the spacing between the input/output electrode and the second ground electrode, the versatility in design can be significantly improved.

Figure 2:
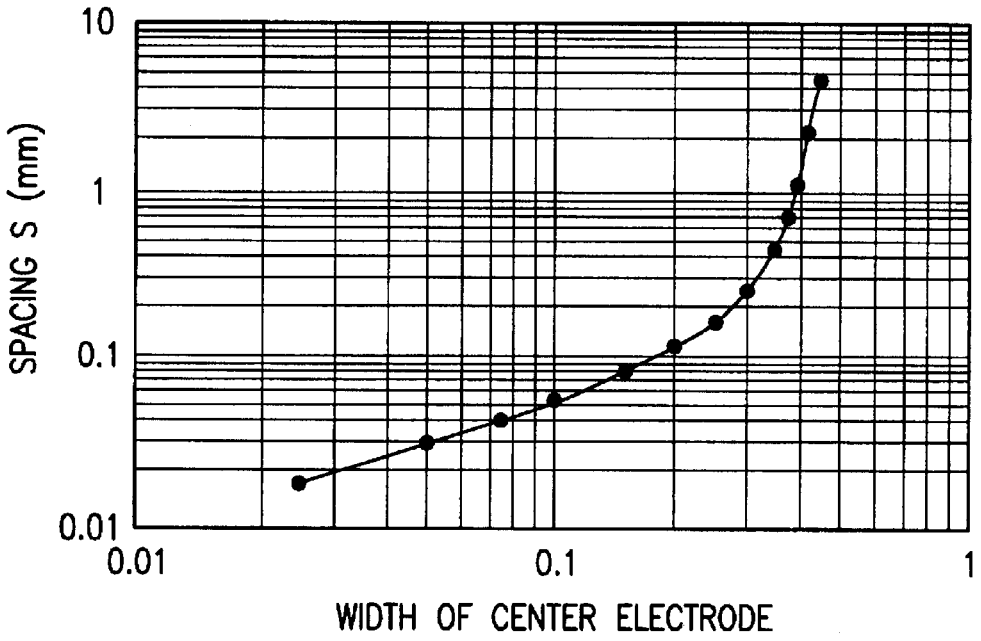
FIG. 2 is a diagram illustrating the relationship between the width of the center electrode and the spacing between the center electrode and the ground electrode of the filter shown in FIG. 1, when the impedance of each of the input/output portions thereof is constant.

FIG. 2 shows the relationship between the spacing S between the input/output electrodes (also referred to as the center electrodes) 21 and 23, and the second ground electrode 51, and the input/output electrode width WC when the line impedance is set to 50 Ω, In this example, the thickness of the dielectric substrate is set to 0.38 mm, the dielectric constant is 9.6, and the frequency is 25 GHz. Even though the thickness of the dielectric substrate and the dielectric constant are constant in this way, the width WC and the spacing S can be set over a wide range, whereby the versatility in design for obtaining a predetermined line impedance is enhanced.

In this first embodiment, the ratio (W/L) between the electrode width W and the electrode length L is set to a value smaller than 1.0 and the lead-out positions of the input/output electrodes are shifted toward the same direction (the positions are on the same side with respect to the chain line in the figure) as measured from the center in the longitudinal direction of the first-stage and last-stage resonator electrodes 11 and 13. The present inventor has found from his experiments that this configuration creates an attenuation pole on the higher frequency side in the pass band. The reason for this is considered to be as follows. When the values of the electrode length and the electrode width of the first-stage electrode 11 are substantially equal to those of the last-stage electrode 13, respectively, there appears a resonance mode in the direction perpendicular to the primary resonance mode of the resonator electrodes 11 and 13, that is, a secondary resonance mode which has the width designated by W, as a resonator length, and which has the length designated by L, as an electrode width, and the resonance frequency in this secondary resonance mode approaches that in the primary resonance mode, with the result that these two resonance frequencies are combined.

Figure 3A:
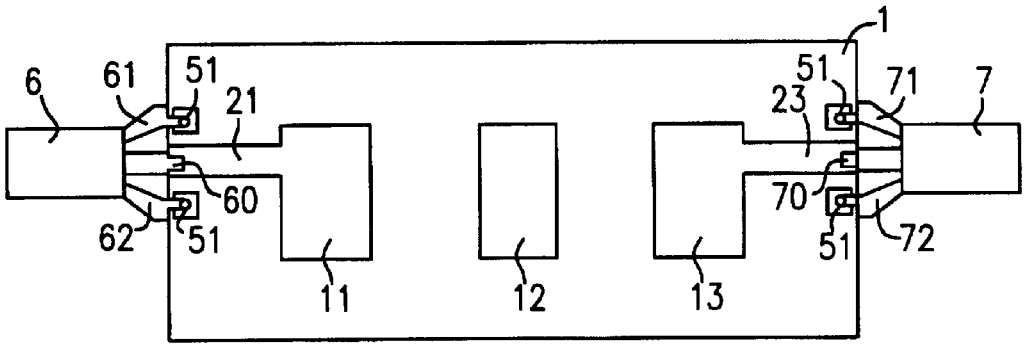
Figure 3B:
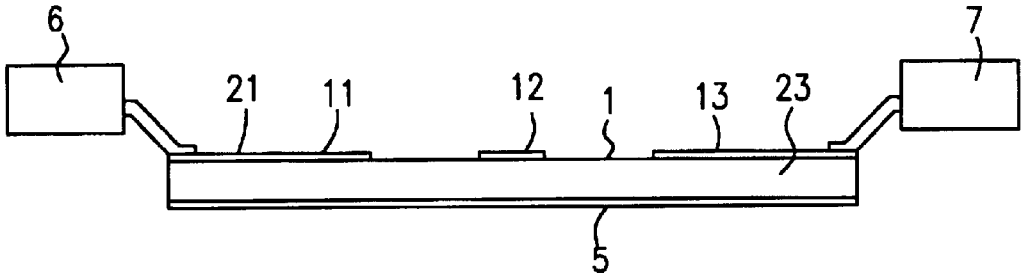

FIGS. 3A and 3B are diagrams showing a measuring method for the characteristics of the above-described filter, wherein FIG. 3A is a top view, and 3B is a side view. In FIGS. 3A and 3B, probes 6 and 7 are provided for measuring the electrical characteristics of the resonators. The probes 6 and 7 have center electrodes 60 and 70, respectfully. They also have ground electrodes 61 and 62, and ground electrodes 71 and 72, respectively. By placing these electrodes in contact with the input/output electrodes 21 and 23 of the filter and the second ground electrodes 51, the electrical conduction between these electrodes is established.

In the method shown in FIGS. 3A and 3B, the probes of a measuring instrument are merely abutted against the resonator electrodes and the second ground electrodes all of which are exposed two-dimensionally on the top surface of the dielectric substrate, and hence, even a small-scale filter can be measured. Furthermore, a measurement calibration can be easily performed by the probe terminal surfaces, using the so-called SOLT (Short-Open-Load-Thru) method or the like.

Figure 4:
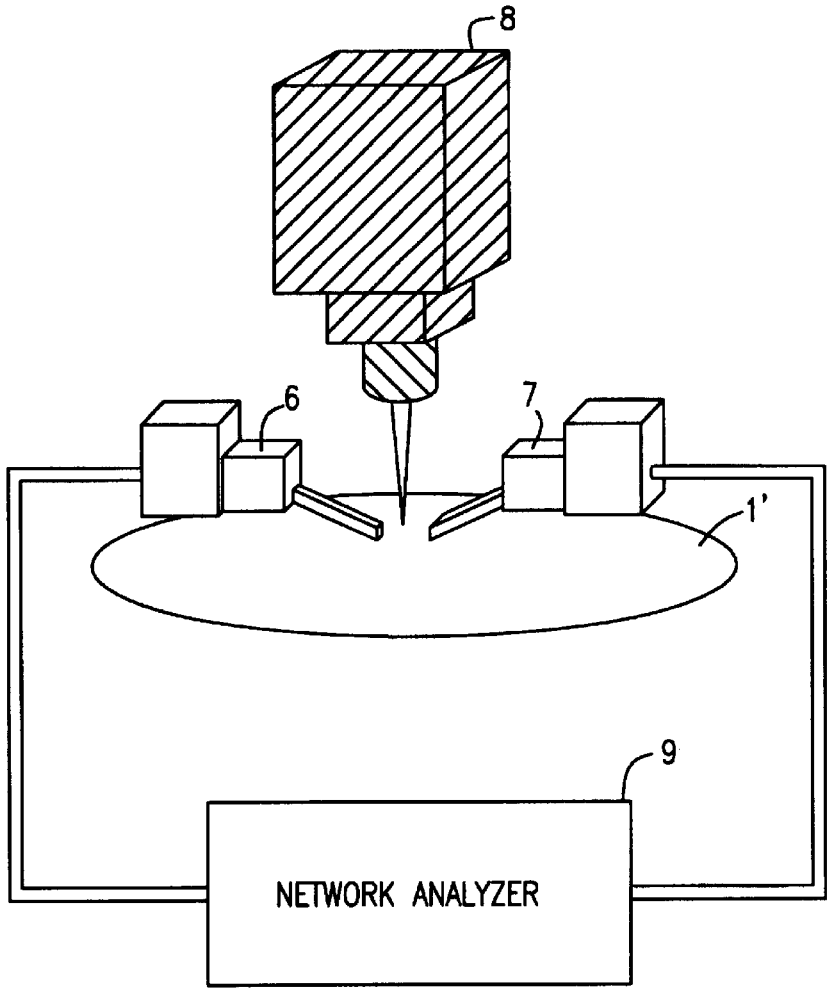
FIG. 4 is a view illustrating how the characteristics of the above-described filters are measured and adjusted.

FIG. 4 is a view illustrating how the characteristics of the above-described filters are measured and adjusted. In FIG. 4, a plurality of dielectric substrates 1, before being separated, are included in an aggregate substrate 1'. The aggregate substrate 1' is placed on an X-Y table (not shown), and the aggregate substrate is movable to arbitrary positions in the plane defined by the table, with respect to the probes 6 and 7, and a laser device 8. Each of the probes 6 and 7 is connected to a network analyzer 9, and is arranged so that the tip thereof contacts the input/output portions of one filter part which is at a predetermined segment of the aggregate substrate 1'. The contact conditions of the probes with respect to this filter part are similar to those shown in FIGS. 3A and 3B. In FIG. 4, the laser device 8 trims predetermined portions of the resonator electrodes and dielectric substrates on the aggregate substrate.

In this way, by measuring the electrical characteristics of the filters, while the dielectric substrates are still in the form of an aggregate substrate, and by performing laser trimming so as to obtain predetermined electrical characteristics, it is possible to perform, at one time, the adjustment of the characteristics of large numbers of filters. In this case, since it is unnecessary for discrete dielectric substrates to be mounted or demounted with respect to jigs, cracking and chipping of the dielectric substrates hardly occurs. If the results of the measurement of the electrical characteristics of the filter indicate that the desired characteristics within the range of predetermined characteristics cannot be obtained by trimming, then, by marking the segment of the corresponding filter with ink or the like, wasteful man-hours conventionally needed for handling rejected components will be avoided later in the process.

The trimming-off of the resonator electrode portions or the dielectric substrate portions may be performed by means of a luter or a sand-blaster, in addition to the laser trimming method.

Next, the configuration of a filter in accordance with a second embodiment of the present invention will be described with reference to FIG. 5.

Figure 5:
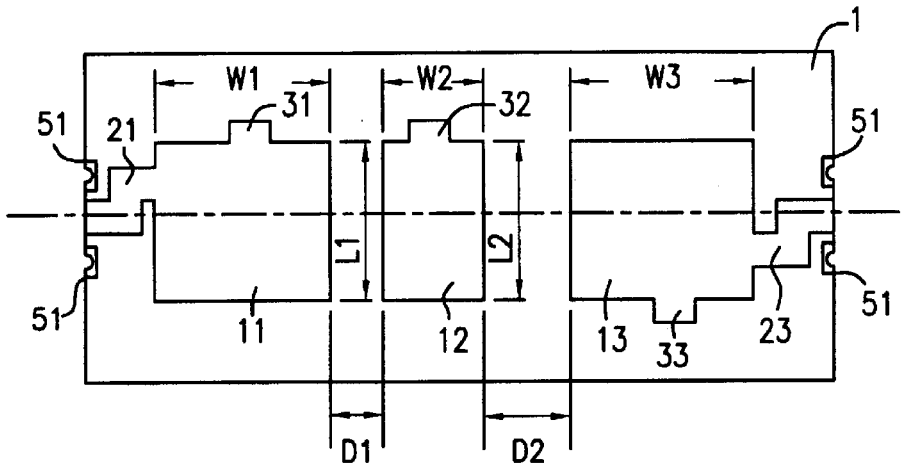
FIG. 5 is a top view illustrating a filter in accordance with a second embodiment of the present invention.

FIG. 5 is a plan view showing this filter. On the top surface of the dielectric substrate 1, three resonator electrodes 11, 12, and 13, and input/output electrodes 21 and 23 are formed. Second ground electrodes 51 are disposed on both sides of each of the input/output electrodes 21 and 23.

In this case, the second ground electrodes 51 are arranged so as to be conductively connected to the first ground electrode on the bottom surface via the side electrodes on the side surfaces of the dielectric substrate 1. Specifically, through holes have previously been formed which allow the second ground electrodes 51 and the first ground electrode on the bottom surface to be conductively connected to each other, at the positions where the cutting lines (snap lines) pass for cutting the dielectric substrate off from an aggregate substrate. Then, the aggregate substrate is cut off along these cutting lines, that is, along the lines each passing through the through holes, whereby the connection portions between the second ground electrodes on the top surface and the first ground electrode on the bottom surface of the dielectric substrate are formed.

As in the case of the filter in accordance with the first embodiment, each of the above-described resonator electrodes 11, 12, and 13 also functions as a microstrip line resonator which generates a half-wavelength resonance at the operational frequency band thereof. However, the shapes of the resonator electrodes in this second embodiment, differ from those in the first embodiment. Specifically, in this second embodiment, in the first-stage resonator electrode 11 and the resonator electrode 12, projections 31 and 32 are formed, respectively, on one side with respect to the center line indicated by the chain line in the figure, while in the last-stage resonator electrode 13, a projection 33 is formed on the other side with respect to the center line. The input/output electrodes 21 and 23 are each formed on the center line near the side surfaces of the dielectric substrate 1, but the connection positions thereof with the respective resonator electrodes 11 and 13 are formed on different sides with respect to the center line.

In a microstrip line filter wherein a plurality of resonator electrodes each of which constitutes a half-wavelength resonator, are thus disposed on a dielectric substrate substantially parallel with each other, and wherein an input/output electrode is connected to each of the first-stage and last-stage resonator electrodes, the present inventor has found the following fact from his experiments. An attenuation pole occurs on the lower frequency side in the pass band, when the electrode lengths L1 and L3 of the respective resonator electrodes 11 and 13 are set so that the center frequency in the pass band becomes a desired frequency, when the ratio (W/L) between the electrode width W and the electrode length L is set to be larger than 1.0, and when the lead-out positions of the input/output electrode as seen from the center in the longitudinal direction of the first-stage and last-stage resonator electrodes are shifted toward different respective directions in the first-stage resonator electrode 11 and the last-stage resonator electrodes 13. This would also be because, when the values of the electrode length and the electrode width of the first-stage electrode 11 are substantially equal to those of the last-stage electrode 13, respectively, there appears a secondary resonance mode in the direction perpendicular to the primary resonance mode of the resonator electrodes 11 and 13, with the result that these two resonance frequencies are combined.

In the example shown in FIG. 5, the electrode width W1 of the first-stage electrode 11 is not equal to the electrode width W3 of the last-stage electrode 13, and consequently the distances D1 and D2 between the three resonator electrode 11, 12, and 13 are set to different values from each other.

In FIG. 5, projections 31, 32, and 33 are frequency adjusting electrodes which project from the resonator electrodes 11, 12, and 13, respectively, in the longitudinal direction thereof. By trimming off these portions by as much as required by the laser trimming method or the like, as shown in FIG. 4, the resonance frequency of each stage of the resonator electrodes can be adjusted.

Figure 6:
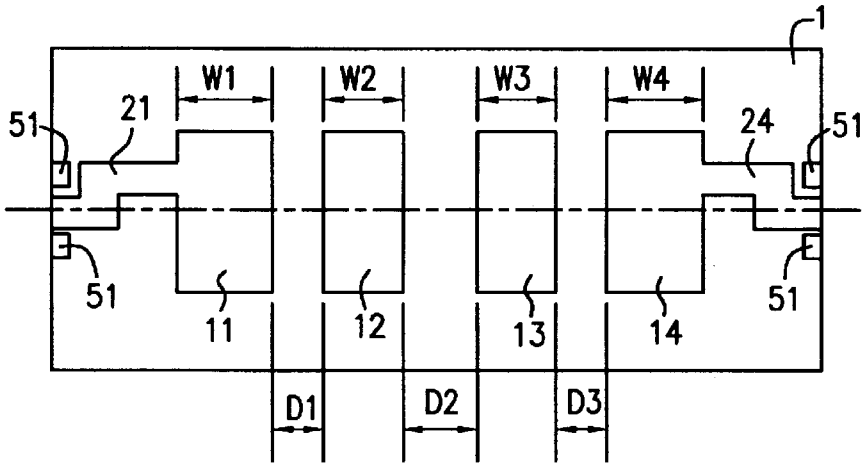
FIG. 6 is a top view illustrating a filter in accordance with a third embodiment of the present invention.

FIG. 6 is a top view showing a filter in accordance with a third embodiment of the present invention. In this example, four resonator electrodes 11 through 14 each of which constitutes a half-wavelength resonator, are disposed on a dielectric substrate 1 substantially parallel with each other, and input/output electrodes 21 and 24 are connected to the first-stage and last-stage resonator electrodes 11 and 14, respectively. Second (top surface) ground electrodes 51 which are conductively connected to the first ground electrode on the bottom surface, are disposed on both sides of each of the input/output electrodes 21 and 24. Such a structure can be obtained by forming side electrodes which connect the second ground electrodes 51 and the first ground electrode to each other, on the end faces of the dielectric substrate, after the dielectric substrate has been cut off from an aggregate substrate.

Next, a constructional example of a duplexer will be described with reference to FIG. 7.

Figure 7:
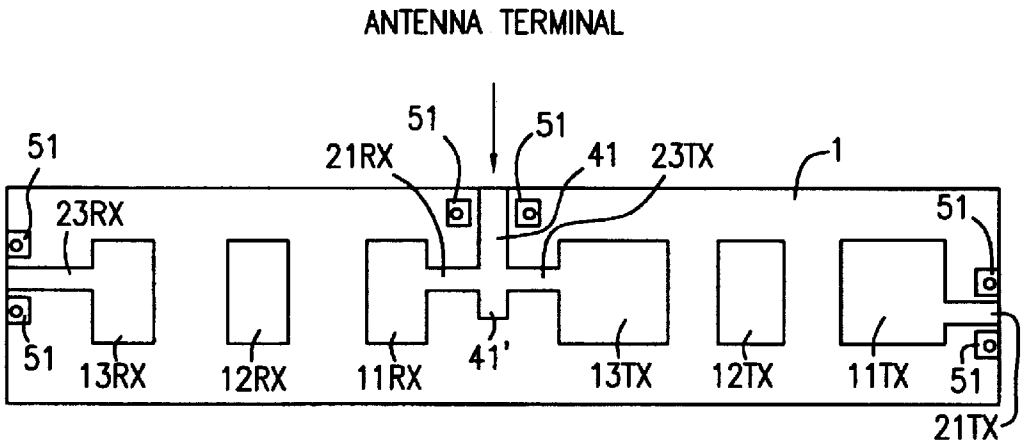
FIG. 7 is a top view illustrating a duplexer in accordance with a fourth embodiment of the present invention.

In FIG. 7, six resonator electrodes 11TX, 12TX, 13TX, 11RX, 12RX, and 13RX are formed on the top surface of a dielectric substrate 1. Between a transmitting-side circuit terminal (input/output electrode) 21TX and an antenna terminal 41, a transmission filter is formed by the three resonators by the three resonator electrodes 11TX, 12TX, and 13TX. On the other hand, between a receiving-side circuit terminal (input/output electrode) 23RX and an antenna terminal 41, a reception filter is formed by the three resonators by resonator electrodes 11RX, 12RX, and 13RX. On the top surface of the dielectric substrate 1, the input/output electrode 21TX is connected to the first-stage resonator electrode 11TX of the transmission filter, and a lead-out electrode 23TX with respect to the antenna terminal 41 is connected to the last-stage resonator electrode 13TX. A lead-out electrode 21RX, which is connected to the antenna terminal 41, is connected to the first-stage resonator electrode 11RX of the reception filter, and the input/output electrode 23RX is connected to the last-stage resonator electrode 13RX. Each of the lead-out electrodes 23TX and 21RX are connected to a predetermined position of the antenna terminal 41. A first ground electrode is formed substantially over the entire bottom surface of the dielectric substrate 1. Second (top surface) ground electrodes 51, which are conductively connected to the first ground electrode on the bottom surface, are disposed on both sides of each of the input/output electrodes 23RX, 21TX, and 41.

An electrode 41' for impedance matching extends from the connection point between the input/output electrodes 23TX and 21RX and the antenna terminal 41. Thus, impedance matching between the antenna terminal 41 and these two input/output electrodes 23TX and 21RX is achieved.

Thus, a duplexer (an antenna sharing device) is formed wherein the input/output electrode 21TX portion as a transmitting-circuit side terminal, the input/output electrode 23RX portion as a receiving-circuit side terminal, and the antenna terminal 41 have a grounded coplanar structure.

The transmission filter comprising the resonator electrodes 11TX, 12TX, and 13TX is fundamentally similar to the filter shown in FIG. 5, and generates an attenuation pole on the lower frequency side of the transmission frequency band which is the pass band of this filter. On the other hand, the reception filter comprising the resonator electrodes 11RX, 12RX, and 13RX is similar to the filter shown in FIG.

1, and generates an attenuation pole on the higher frequency side of the reception frequency band which is the pass band of this filter. In a communication system wherein a reception frequency band is set adjacent to the lower side of a transmission frequency band, the use of this duplexer reliably prevents the mixing of transmitted signals into received signals, by the attenuation characteristics of the respective attenuation poles of the transmission filter and the reception filter.

In the above-described embodiments, examples have been given wherein the second ground electrodes are provided on both sides of each of the input/output electrodes, but the second ground electrode may be disposed on only one of the sides of each of the input/output electrodes.

Also, in the above-described embodiments, each of the input/output portions is formed as a grounded coplanar structure. However, only a predetermined one of a plurality of input/output portions may be provided with a grounded coplanar structure, depending on the use of the filter or duplexer.

Figure 8:
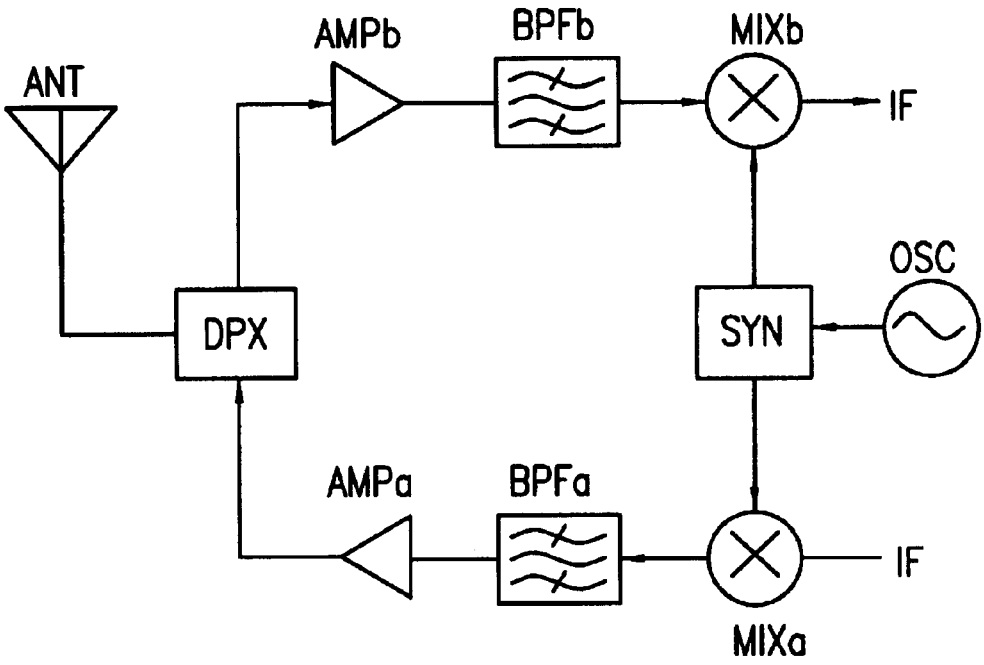
FIG. 8 is a diagram illustrating the configuration of a communication device in accordance with a fifth embodiment of the present invention.
Figure 9:
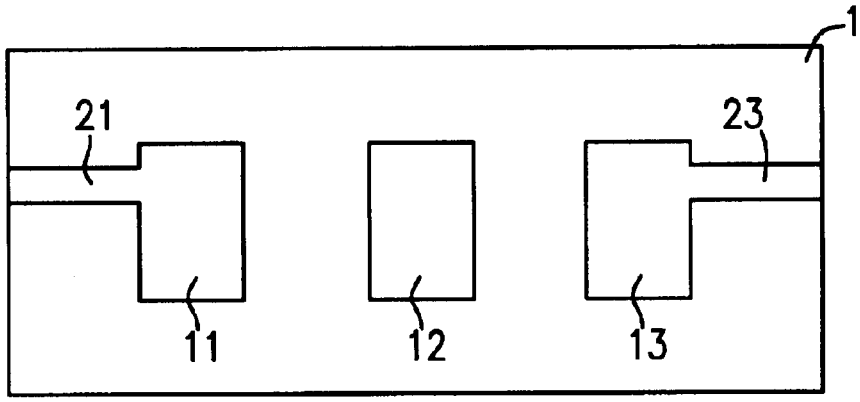
(PRIOR ART) FIG. 9
FIG. 9 is a top view illustrating the configuration of a conventional filter.

Next, a constructional example of a communication device will be described with reference to FIG. 8. In FIG. 8, reference character ANT designates a transmitting/receiving antenna, and DPX a duplexer. BPFa and BPFb each designates band pass filters, AMPa and AMPb amplifier circuits, and MIXa and MIXb mixers. OSC designates an oscillator, and SYN a synthesizer.

MIXa mixes IF signals and signals output from SYN, BPFa passes only the transmission frequency band among the mixed output signals from MIXa, and AMPa power-amplifies these signals and transmits them from ANT via DPX. AMPb amplifies the received signals output from DPX. BPFb passes only the reception frequency band among the output signals from AMPb. MIXb mixes the frequency signals output from SYN and the received signals, and outputs intermediate frequency signals IF.

As the above-mentioned BPFa and BPFb, a microstrip line filter as shown in the above-described embodiments may be used, and as the DPX, a microstrip line duplexer as shown in FIG. 7 may be employed.

As is evident from the foregoing, in accordance with the present invention, since each or at least some of the input/output electrode portions are formed with a grounded coplanar structure, the measurement on the electrical characteristics such as resonance frequency can be achieved by merely abutting the center electrodes of the probes of a measuring instrument against the ground electrodes, on the top surface of the dielectric substrate. Therefore, even small-scaled components can be reliably measured using a two-dimensional measuring jig.

Furthermore, in the present invention, in an aggregate substrate, wherein a plurality of dielectric substrates of filters or duplexers are formed contiguously, before separation, the electrical characteristics of the filters or duplexers are measured by abutting the probes against the input/output electrodes and the second ground electrodes, and the electrical characteristics thereof are adjusted by trimming off portions of resonator electrodes of the dielectric substrate. Thus, it is possible to significantly reduce the overall number of man-hours, and to prevent the occurrence of cracking and chipping in the dielectric substrate when mounted or demounted with respect to jigs, which results in enhanced productivity.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A micro strip line filter, comprising:

(i) a dielectric substrate having a top surface and a bottom surface;

(ii) a plurality of resonator electrodes provided on the top surface of said dielectric substrate, and which include at least a first-stage resonator electrode and a last-stage resonator electrode;

(iii) an input/output electrode which is connected to at least one of said first-stage and last-stage resonator electrodes, and which is provided on the top surface of said dielectric substrate;

(iv) a first ground electrode which is provided on the bottom surface of said dielectric substrate, and which is disposed so as to be opposed to said plurality of resonator electrodes with said dielectric substrate therebetween; and (v) at least one second ground electrode which is provided on the top surface of said dielectric substrate, and which is conductively connected to said first ground electrode and not conductively connected to said resonator electrode that is connected to said input/Output electrode, wherein said input/output electrode and said at least one second ground electrode are arranged on the top surface of said dielectric substrate such that probes of a measuring instrument can contact said input/output electrode and said at least one second ground electrode for measuring the electrical characteristics of said microstrip line filter.

2. A microstrip line filter in accordance with claim 1, wherein said second ground electrode is provided adjacent to said input/output electrode.

3. A microstrip line filter in accordance with claim 1, wherein said at least one second ground electrode includes second ground electrodes which are provided respectively on both sides of said input/output electrode.

4. A microstrip line filter in accordance with claim 1, wherein said first ground electrode and said second ground electrode are connected via a through hole provided in said dielectric substrate.

5. A microstrip line filter in accordance with claim 1, wherein said first ground electrode and said second ground electrode are connected via a side electrode provided on the side surface of said dielectric substrate.

6. A microstrip line filter in accordance with claim 1, wherein said plurality of resonator electrodes is arranged in line from a first end of said dielectric substrate to an opposite second end thereof.

7. A microstrip line filter in accordance with claim 1, wherein the input/output electrode connected to said first-stage resonator electrode is provided at one end of said dielectric substrate, while the input/output electrode connected to said last-stage resonator electrode is provided at the other end of said dielectric substrate.

8. A duplex comprising:

a transmitting-circuit terminal;

a receiving-circuit terminal;

an antenna terminal; and a microstrip line filter in accordance with claim 1 connected between at least one of said transmitting-circuit terminal and said antenna terminal, and said receiving-circuit terminal and said antenna terminal.

9. A communication device comprising:

a high-frequency communication circuit, said circuit comprising, a microstrip line filter in accordance with claim 1.

10. A communication device comprising:

a high-frequency communication circuit, said circuit comprising a duplexer in accordance with claim 8.

11. A method for adjusting the electrical characteristics of microstrip line type resonators, said method comprising:

(a) providing an aggregate substrate which includes a plurality of microstrip line type resonators, each of said microstrip line type resonators comprising:

(i) a dielectric having a top surface and a bottom surface;

(ii) a plurality of resonator electrodes provided on the top surface of said dielectric substrate, and which include at least a first-stage resonator electrode and a last-stage resonator electrode;

(iii) an input/output electrode which is connected to at least one of said first-stage and last-stage resonator electrodes, and which is provided on the top surface of said dielectric substrate;

(iv) a first ground electrode which is provided on the bottom surface of said dielectric substrate, and which is disposed so as to be opposed to said plurality of resonator electrodes with said dielectric substrate therebetween; and (v) at least one second ground electrode which is provided on the top surface of said dielectric substrate, and which is conductively connected to said first ground electrode and not conductively connected to said resonator electrode that is connected to said input/output electrode;

(b) placing probes of a measuring instrument for measuring the electrical characteristics of said microstrip line type resonators in contact with said input/output electrodes and said second ground electrodes on said aggregate substrate; and (c) adjusting the electric characteristics of said microstrip line type resonators while measuring the electrical characteristics of said microstrip line type resonators.

12. A method for adjusting the electrical characteristics of microstrip line type resonators in accordance with claim 11, wherein the resonance frequency of said microstrip line type resonators is adjusted by trimming at least one of said plurality of resonator electrodes.

13. A method for adjusting the electrical characteristics of microstrip line type resonators in accordance with claim 11, wherein the resonance frequency of said microstrip line type resonators is adjusted by trimming said dielectric substrate.

* * * * *